US009227215B2

(12) United States Patent
Jackson et al.

(10) Patent No.: US 9,227,215 B2
(45) Date of Patent: Jan. 5, 2016

(54) DETERMINATION OF COMPOSITION AND STRUCTURE OF A $CO_2$ COMPOSITE SPRAY

(71) Applicants: David Jackson, Saugus, CA (US); Liviu Marian, Los Angeles, CA (US)

(72) Inventors: David Jackson, Saugus, CA (US); Liviu Marian, Los Angeles, CA (US)

(73) Assignee: CLEANLOGIC LLC, Santa Clarita, CA (US)

( * ) Notice: Subject to any disclaimer, the term of this patent is extended or adjusted under 35 U.S.C. 154(b) by 4 days.

(21) Appl. No.: 14/308,697

(22) Filed: Jun. 18, 2014

(65) Prior Publication Data

US 2014/0367483 A1 Dec. 18, 2014

Related U.S. Application Data

(60) Provisional application No. 61/836,635, filed on Jun. 18, 2013, provisional application No. 61/836,636, filed on Jun. 18, 2013.

(51) Int. Cl.

| | |
|---|---|
| ***B05B 12/08*** | (2006.01) |
| ***B05B 7/14*** | (2006.01) |
| ***B08B 7/00*** | (2006.01) |
| ***B24C 1/00*** | (2006.01) |
| ***B24C 7/00*** | (2006.01) |
| ***B65D 83/42*** | (2006.01) |
| ***B65D 83/14*** | (2006.01) |

(52) U.S. Cl.

CPC ..... *B05B 12/082* (2013.01); *B05B 7/1486* (2013.01); *B08B 7/00* (2013.01); *B24C 1/003* (2013.01); *B24C 7/0046* (2013.01); *B65D 83/42* (2013.01); *B65D 83/752* (2013.01)

(58) Field of Classification Search

CPC .. B05B 12/082; B05B 7/0483; B05B 7/1486; B05B 7/1686; G01F 1/78

USPC ..... 239/67–69, 71, 11

See application file for complete search history.

(56) References Cited

U.S. PATENT DOCUMENTS

| | | | | |
|---|---|---|---|---|
| 5,315,793 | A | 5/1994 | Peterson | |
| 5,486,811 | A * | 1/1996 | Wehrle | G08B 17/00 169/23 |
| 5,725,154 | A | 3/1998 | Jackson | |
| 5,853,128 | A | 12/1998 | Bowen | |
| 2003/0058114 | A1 * | 3/2003 | Miller | A62C 35/08 340/577 |
| 2003/0207655 | A1 | 11/2003 | Jackson | |
| 2004/0056765 | A1 * | 3/2004 | Anderson | A62C 35/08 340/522 |
| 2009/0136086 | A1 | 5/2009 | Farina | |
| 2011/0233456 | A1 | 9/2011 | Jackson | |

* cited by examiner

*Primary Examiner* — Davis Hwu

(74) *Attorney, Agent, or Firm* — Law Office of David Hong

(57) ABSTRACT

A method and apparatus for analyzing, maintaining or adjusting the chemical and physical structure of a $CO_2$ Composite Spray in real-time. A light beam is passed through a portion of the $CO_2$ Composite Spray plume, following which the transmitted light is collected using a detector and analyzed using a computer processing device. Light absorption, reflection and/or florescence data are correlated with $CO_2$ particle density and particle size, spray plume length, organic and inorganic spray additives, and water vapor content. The treatment spray geometry is used to optimize and control a $CO_2$ Composite Spray in precision cleaning, machining, and cooling processes.

22 Claims, 5 Drawing Sheets

64 (X1..Xn)
X1
X2
X3
60
62
70 (X1..Xn)
X1
X2
X3
66
68
100
78
Light Transmission (%)
0
72
76
X3
X2
X1
74
80
Exit
Mid-Range
Terminal
100
88
Light Transmission (%)
0
86
82
84
X1
X2
X3
90
Perimeter
Mid-Range
Perimeter

DETERMINATION OF COMPOSITION AND STRUCTURE OF A $CO_2$ COMPOSITE SPRAY

PRIORITY CLAIM

This application claims the benefit of U.S. Provisional Patent Application 61/836,635 (filed 18 Jun. 2013) and 61/836,636 (filed 18 Jun. 2013), which are all incorporated by reference.

BACKGROUND

Field of Invention

The present invention relates to a method for discrete or real-time compositional and structural analysis and control of a dense fluid spray, and specifically to unique carbon dioxide ($CO_2$) solid/gas composite sprays ($CO_2$ Composite Spray™, a Trademark of CleanLogix LLC) used in cleaning, cooling and lubrication applications.

A $CO_2$ Composite Spray is used in a number of industrial applications ranging from the removal of submicron particles from hard disk drive component during an assembly operation to the removal of heat from cutting tools and substrates during a precision machining operation. Examples of conventional apparatuses and methods for generating and using a $CO_2$ Composite Spray are described in U.S. Pat. Nos. 5,725,154 and 7,451,941 by the first named inventor of the present invention. With a diverse range of uses, it is not surprising that there is a need for many types of $CO_2$ spray compositions. For example, a less transparent, dense particle spray may be used to provide cooling capacity. A more transparent, lean particle spray may be used to precision clean surfaces to remove submicron particles. Moreover, spray composition such as pressure, temperature and additive play an important role in the performance of the spray in a particular application. As such, knowledge of the entire geometry of the spray including both physical and chemical aspects is very important. Still moreover, the ability to distinguish spray composition is becoming more critical as robots and vision technology are used to automate the various $CO_2$ composite spray processes used in precision cleaning, machining and cooling applications.

A $CO_2$ Composite Spray in its simplest form is a predetermined concentration of microscopic $CO_2$ particles entrained in a propellant gas. A $CO_2$ Composite Spray can be adjusted to produce a low $CO_2$ particle density to a high $CO_2$ particle density, with $CO_2$ particles having a certain size distribution range and the entire composition mixed and propelled to range of spray particle velocities. The adjustments from a simple $CO_2$ Composite Spray can result in an infinite number of possible spray patterns or geometries. This spray control capability is also characterized by a visual change in spray opacity—from highly transparent (termed a lean spray herein) to nearly opaque (termed a rich spray herein). The $CO_2$ particle density and particle size is varied for a number of reasons, most importantly for controlling the cleaning and/or cooling capacity of the spray. In another example, a water "wet" $CO_2$ Composite Spray is useful for providing additional (free) cooling capacity from the atmosphere, for example during the machining of polymers. The wetness factor—that is the condensed water vapor content within the $CO_2$ Composite Spray, is not easily discernible from visual or thermal measurements because it is dependent upon numerous independent and co-dependent variables—spray propellant temperature and mass flow, $CO_2$ particle size and density, and ambient temperature and humidity. In still another example, and more complex $CO_2$ Composite Spray compositional schemes, additives such as ozone gas are useful ingredients in a $CO_2$ Composite Spray for cleaning and machining applications. It is very difficult to precisely determine and control the amount of ozonation in a $CO_2$ Composite Spray. The present invention overcomes all of these spray composition analysis and control constraints common to $CO_2$ Composite Spray applications. Modular spectroscopy components are used in the present invention to assemble a range of setups to measure the interaction of light with one or more $CO_2$ composite spray plumes. Ultraviolet (UV), Visible (VIS), and Near-Infrared (NIR) transmission, as well as Raman absorption measurements, may be used to provide a straightforward method to dynamically and quickly assess various physical and chemical aspects of a $CO_2$ Composite Spray, for example both $CO_2$ particle density as well as chemical additives that may be contained or entrained therein. The present invention may be used on-line for discrete or real-time analysis during $CO_2$ Composite Spray processing to provide automatic spray compositional analysis and control, or provide simple quality control validation monitoring. Data derived from light measurements are be used to adjust internal spray composition components such as $CO_2$ pressure, temperature, and mass flow rate; gaseous propellant temperature, pressure and mass flow rate; and additive dosage. Most importantly, data derived from light measurements is used herein to optimize the performance of the $CO_2$ Composite Spray—for example during a cleaning operation, a machining operation, or a cooling operation—to provide optimal productivity and economy of the operation.

SUMMARY OF THE INVENTION

A method and apparatus for analyzing, maintaining or adjusting the chemical and physical structure of a $CO_2$ Composite Spray in real-time. A light beam is passed through a portion of the $CO_2$ Composite Spray plume, following which the transmitted light is collected using a detector and analyzed using a computer processing device. Light sources include wide-spectrum and specific wavelengths such as halogen, deuterium, Laser and LED, and operate in the ultraviolet, visible and infrared region. Detectors include simple photodiode detectors for measuring radiance or intensity, and more sophisticated analytical spectrophotometers. Computer processing devices include a personal computer or process logic controller. Light absorption, reflection and/or florescence data are correlated with $CO_2$ particle density and particle size, spray plume length, organic and inorganic spray additives, and water vapor content. The treatment spray geometry may be correlated with metrological instruments and methods and is used to optimize and control a $CO_2$ Composite Spray in precision cleaning, machining, and cooling processes.

An object of the present invention is to provide a robust method and apparatus for real-time compositional and structural analysis of a $CO_2$ Composite Spray;

A further object of the invention is to provide a compositional and structural analysis method using ultraviolet, visible, and/or near-infrared light-based radiance and/or photometric measurements;

Another object of the invention is to provide a method for determining the density of particles of solid carbon dioxide entrained in a propellant gas and determining the changes in $CO_2$ particle density therein;

Another object of the invention is to provide a method for determining the quantity of gaseous, liquid or solid inorganic and organic additives contained or entrained in a $CO_2$ Composite Spray;

Another object of the invention is to provide a method for analyzing single or multiple $CO_2$ Composite Sprays; and Another object of the invention is to provide a method for analyzing the composition and structure of a $CO_2$ Composite Spray in an in-line or longitudinal direction and in a perpendicular direction.

In the prior art, adjustments to (and control of) the $CO_2$ Composite Spray are typically performed manually based upon visual opacity or have been performed automatically using a thermocouple to correlate the $CO_2$ particle density of the spray at various propellant mass flow pressure/nozzle) and fixed propellant heat capacity (temperature/mass flow) settings. The visual method of control is subjective and produces inconsistencies in both cleaning and cooling performance, and is not a feasible option for on-line or continuous applications requiring automatic control and consistent performance. The thermodynamic control method provides automatic analysis and control vis-à-vis automated pressure and mass flow regulators, but is slow and provides only mixing temperature information for the spray composition, irrespective of all of the adjustable variables inherent in a $CO_2$ Composite Spray. The conventional analysis and control methods do not provide information about the physical or chemical form or profile of a $CO_2$ Composite Spray—which relates to mass flow rates, pressures, temperatures, $CO_2$ particle size distribution, and chemical or physical additives which may be contained or entrained within the spray plume. In the present invention, spectroscopic analysis using UV, VIS, NIR light, and which may include specialized spectroscopic techniques such as Raman analysis, is used to assess both the chemical and physical characteristics of a $CO_2$ Composite Spray to optimize its performance in cleaning, machining, and cooling operations.

Measurements may be based upon light absorption, reflection or emission phenomenon. For example, ozonation is used as an additive within a $CO_2$ Composite Spray and its spray concentration is roughly estimated from ozone production and metering control techniques, which can vary significantly. The present invention can simultaneous determine the $CO_2$ particle concentration (physical) and ozone concentration (chemical) within the plume directly.

In the present invention, $CO_2$ particle density is ascertained based on physical light obscuration (light blocking/rejection) as well as light absorption in the 2 micron infrared wavelength region. Oxygen and ozone absorb the UV region, and water vapor absorbs in the near-IR region. Similarly and not shown, other chemical or physical additives which absorb or obscure light can be monitored and controlled using the present invention. A suitable light source is coupled with a suitable spectrophotometer or a simple radiance (or gross light transmission) or light intensity measurement device is used in the present invention to determine various physical and chemical aspects of a dynamic $CO_2$ Composite Spray using light absorbance, fluorescence, reflectance, transmission, or Raman measurement. A wide-spectrum light source such as deuterium, tungsten or halogen (215 nm-2500 nm) or more specific spectrum sources such as LED or Laser may be used, including monochromatic radiation, near monochromatic radiation, continuous spectra and band spectra light sources. Simple radiometric or more complex photometric measurement techniques may be employed in the present invention, dependent upon the amount of information needed to properly assess the physical and chemical characteristics of a particular $CO_2$ Composite Spray.

An exemplary light measurement scheme uses spectroscopic light. Spectroscopic light is passed through the spray plume body to assess the chemistry, density and/or physical shape of the $CO_2$ Composite Spray. A simple radiance measurement may be used in the present invention to determine apparent spray density at a particular and representative portion of a spray plume. This information is used to characterize or profile the $CO_2$ spray plume for quality, performance, real-time dynamic control. Examining the shape of a spray plume, its profile, is another and more accurate means for contrasting and comparing the plume shape of a $CO_2$ Composite Spray. As an example, the area under a representative portion of a curve representing a profile (radiance or photometric values) may be determined by integrating the curve function using two representative measurement boundary values (% transmission, % absorption, intensity etc.).

In the present invention, wide-spectrum light transmission measurements are used to differentiate $CO_2$ Composite Sprays having varying $CO_2$ particle densities and chemical additive concentrations, which are not possible to discriminate visually. The power of light transmission measurements to discriminate similar spray plumes is demonstrated by the different transmission intensities measured for spray compositions having similar $CO_2$ particle densities. The ability to discriminate $CO_2$ Composite Sprays makes this technique very useful for quality assurance (QA) or quality control (QC) operations to ensure consistent spray characteristics and spray performance in a particular application.

Other objects and advantages of the present invention will become apparent from the following description and accompanying drawings.

BRIEF DESCRIPTION OF THE DRAWINGS

The accompanying drawings, which are incorporated into and form a part of the disclosure, illustrate an embodiment of the invention and, together with the description, serve to explain the principles of the invention.

The present invention will be best understood from the following description when read in conjunction with the accompanying drawings.

DETAILED DESCRIPTION OF THE INVENTION

The present invention is a novel method for real-time compositional and structural analysis and control of a dense fluid spray, and specifically to unique carbon dioxide ($CO_2$) solid/gas composite sprays ($CO_2$ Composite Spray™, a Trademark of CleanLogix LLC) used in cleaning, cooling and lubrication applications. It will be best understood and appreciated by reference to the following discussion in conjunction with the attached annotated drawings.

Figure 1:
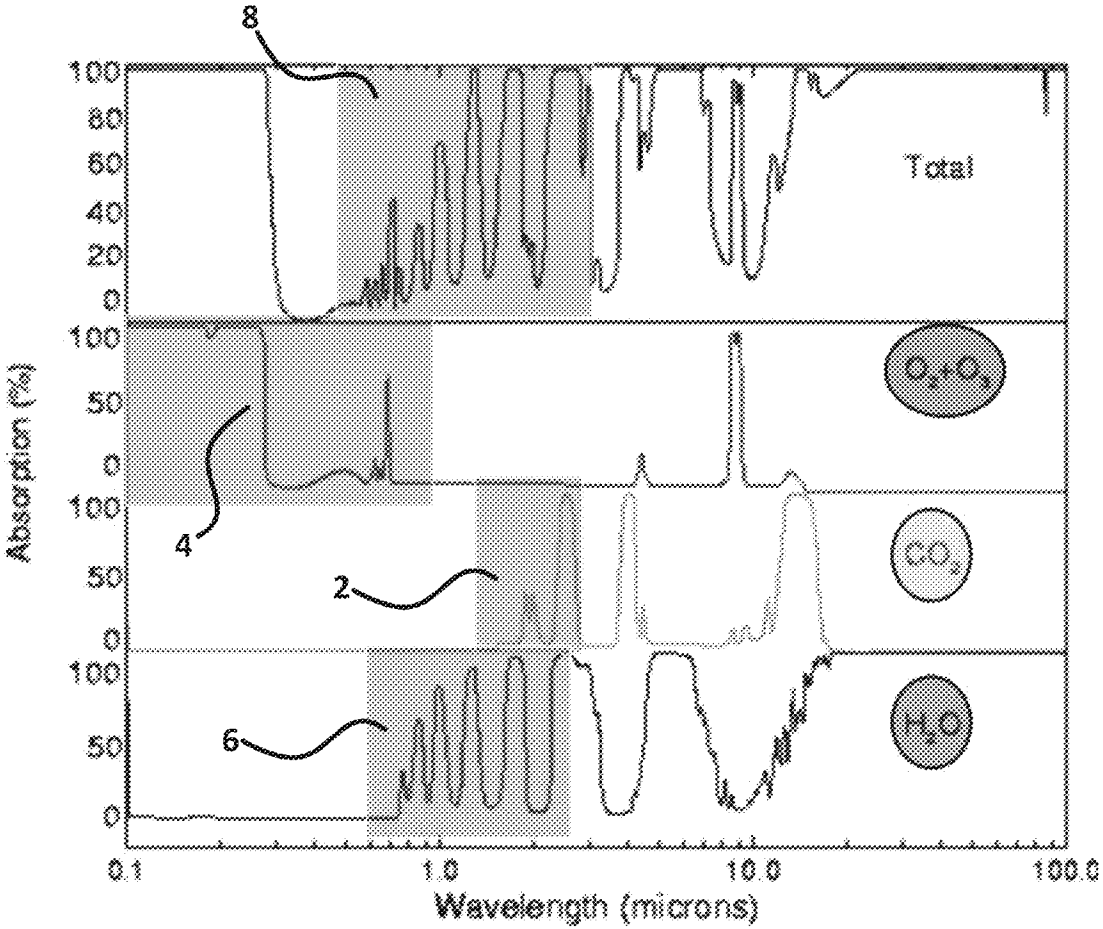
FIG. 1 illustrates exemplary absorption profiles for various chemistries common to a $CO_2$ Composite Spray.

FIG. 1 illustrates exemplary absorption profiles for various chemistries common to a $CO_2$ Composite Spray. Common chemistries found within a $CO_2$ Composite Spray include air (nitrogen, oxygen), carbon dioxide, and water vapor (purposely injected or condensed from the atmosphere). As shown in the FIG. 1, each compound has a unique absorption fingerprint or profile—carbon dioxide absorbs in the infrared region (2), oxygen and ozone absorb in the ultraviolet region (4), and water vapor absorbs in the visible to infrared region (6). An overlay of carbon dioxide, oxygen/ozone and water demonstrates a significant amount of absorption from the ultraviolet to infrared region (8). The present invention provides various light-based means for differentiating the components of a $CO_2$ Composite Spray, and using this information to adjust (and maintain) individual components for optimal spray performance in cleaning, cooling and machining operations.

Figure 2:
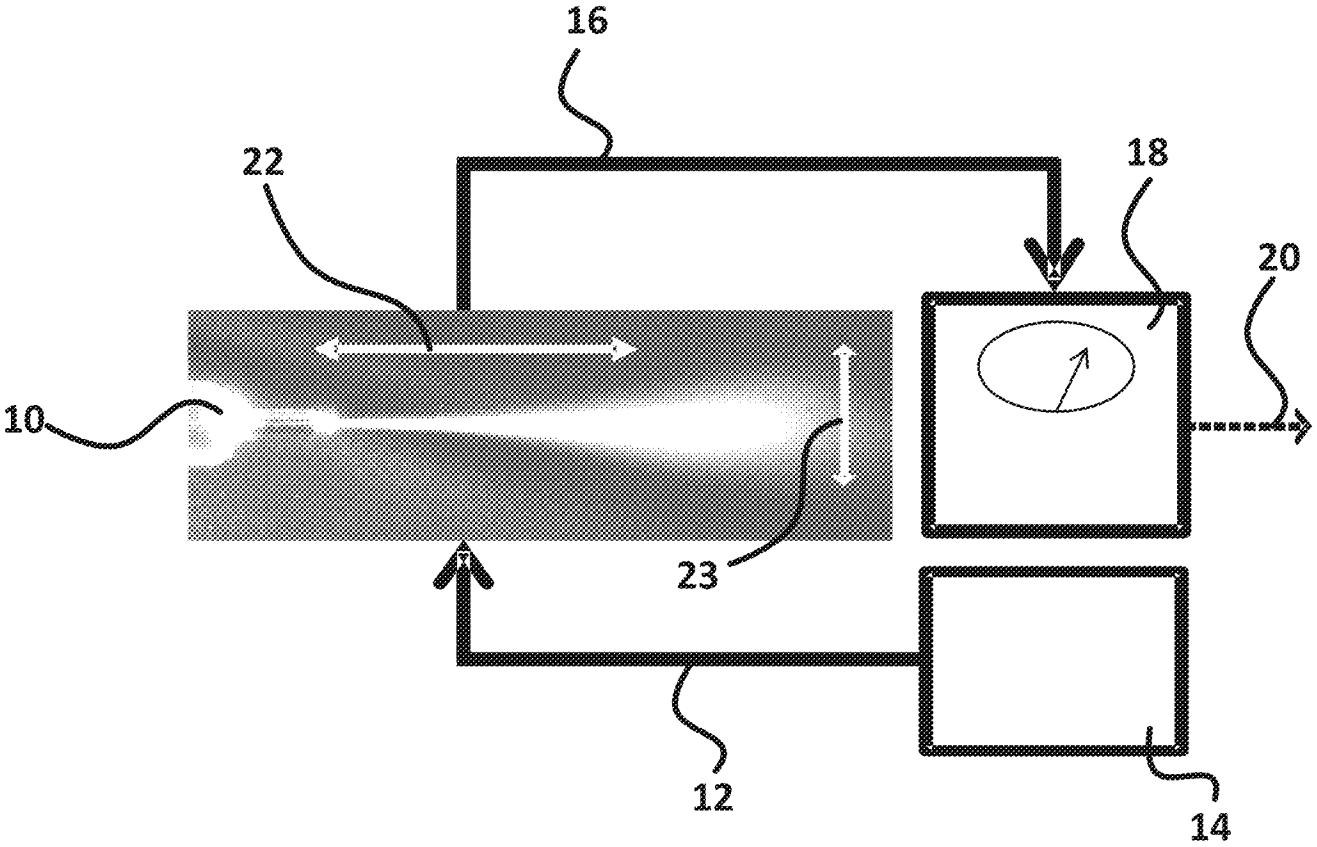
FIG. 2 illustrates schematically the apparatus embodiments of a light-based compositional and structural analysis system for profiling a $CO_2$ Composite Spray.

FIG. 2 illustrates schematically the apparatus embodiments of a light-based compositional and structural analysis system for profiling a $CO_2$ Composite Spray. Referring to FIG. 2, a $CO_2$ Composite Spray nozzle and plume (10) is positioned between a beam of light (12), derived from any number of light sources (14) including wide spectrum deuterium, tungsten, and/or halogen, operating in the range of between 200 nm and 2500 nm, as well as more specific light spectra sources derived from LED or Laser. Transmitted light (16) which has been passed through one or more portions of the spray plume (10) is piped into a photometric analyzer or light detector (18). Exemplary detectors (10) suitable for practicing the present invention include various spectrophotometers available from Ocean Optics, Dunedin, Fla. and photodiode-based light detectors available from Gigahertz-Optik, Newburyport, Mass. Various types of analysis can be performed on the transmitted light (16), and which is dependent upon the type of light source (14) and detector (18). Exemplary analytical techniques include absorbance, fluorescence, reflectance, transmission, and Raman measurements. The various analyses produce a data set in the form of electrical values (20) which can be normalized and processed to form a fingerprint or profile for a given $CO_2$ Composite Spray having a certain $CO_2$ particle size distribution, particle density (particles-in-propellant), additive scheme, pressure and temperature. For example, one or more measurements can be made along the spray plume longitudinally (22) at different positions along the traverse or perpendicularly (23) facing the spray plume to determine the chemical and physical aspects (and changes thereof), including both chemical content and structural information, from the nozzle exit to a predetermined distance along its trajectory (longitudinal plume measurements) or from side-to-side (perpendicular plume measurements) at a certain distance from the nozzle exit.

Figure 3:
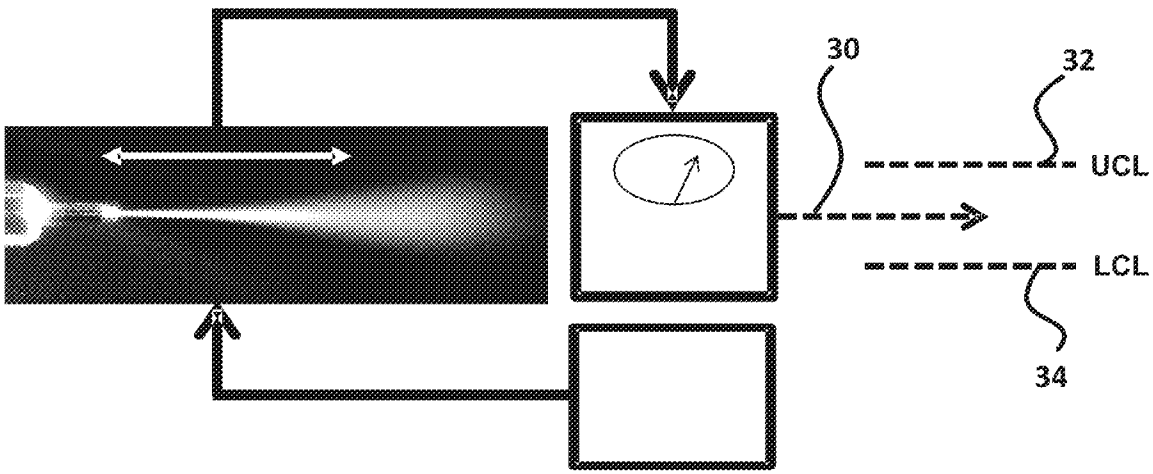
FIG. 3 illustrates schematically the use of radiance and photometric spray plume data to establish an upper control limit (UCL) and lower control limit (LCL) for compositional elements such as $CO_2$ particle density, additive concentration, and water content.

FIG. 3 illustrates schematically the use of radiance and photometric spray plume data to establish an upper control limit (UCL) and lower control limit (LCL) for compositional elements such as $CO_2$ particle density, additive concentration, and water content using the exemplary system described under FIG. 2. Now referring to FIG. 3, a library of profiles derived from the analytical data (30) can be established for different $CO_2$ Composite Sprays and used for adjusting or maintaining same during the application of the spray within a cleaning, cooling or machining operation. Upper control limits (32) and lower control limits (34) can be established and which can be used by an operator or automatic controls to maintain various spray components within acceptable limits. Such a quality control-assurance scheme is extremely useful, for example, in precision particle cleaning applications where there is a direct correlation between the cleaning rates (submicron particle removal rate) and multi-variant $CO_2$ particle density, particle size, spray pressure, and spray temperature.

Figure 4:
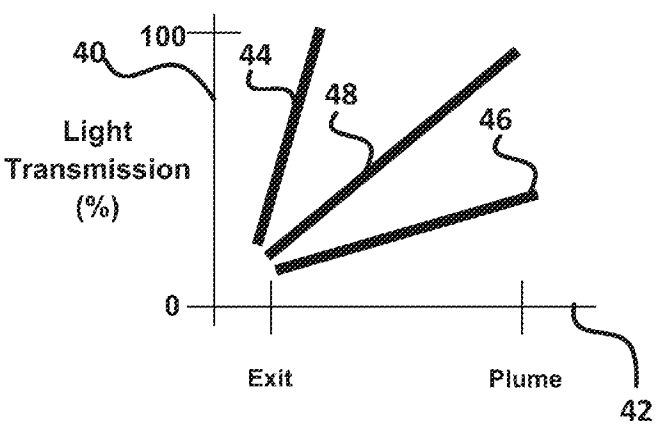
FIG. 4 schematically illustrates exemplary spray profiles derived from radiance measurements of a $CO_2$ Composite Spray.

FIG. 4 schematically illustrates exemplary spray profiles derived from radiance measurements of a $CO_2$ Composite Spray. As shown in FIG. 4, a spray profile can be established using the apparatus of FIG. 2, and for example using a wide-spectrum light source such as a halogen light and photodiode detector to measure light transmission changes through the spray plume. Employing the analytical apparatus of FIG. 2 upon one or more predetermined points along the spray plume produces a fingerprint or profile, which is dependent upon multiple spray composition variables including $CO_2$ particle density, particle size distribution, propellant pressure and mixing temperature, additives and additive concentrations. Correlating the percent (%) light transmission level (40) at various positions (42) along the spray plume produces a unique spray profile (P) for each unique $CO_2$ Composite Spray composition. Exemplary spray profiles include a lean spray profile (44), a rich spray profile (46), and an optimal spray profile (48), possessing the optimum composition for a particular spray application.

Figure 5:
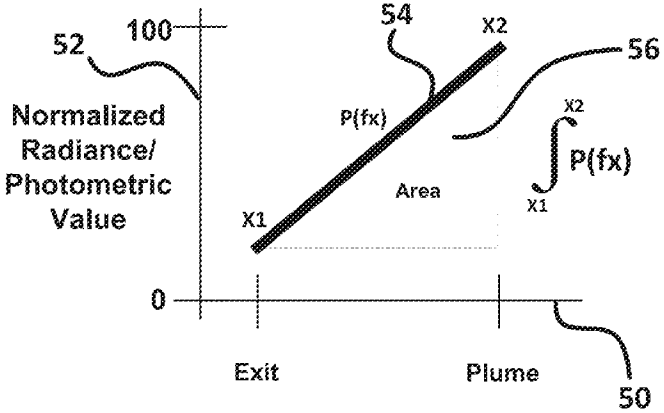
FIG. 5 schematically illustrates the computation of a spray profile metric—area under the profile curve—used for quickly analyzing and controlling a $CO_2$ Composite Spray.

Optimal spray profiles derived from the present invention can be further analyzed to determine a fingerprint value for a particular $CO_2$ Composite Spray composition. FIG. 5 schematically illustrates the computation of a spray profile metric derived from the area under the optimal profile curve. This value is termed a Spray Profile Index (or "SPI") herein and is useful for quickly assessing and controlling a $CO_2$ Composite Spray. Basically two spray positions (50) representing representative profile of the optimum $CO_2$ Composite Spray plume and having unique normalized radiance or photometric data values (52), are used to integrate the optimal curve equation (54) to produce a unique SPI value (56).

Figure 6:
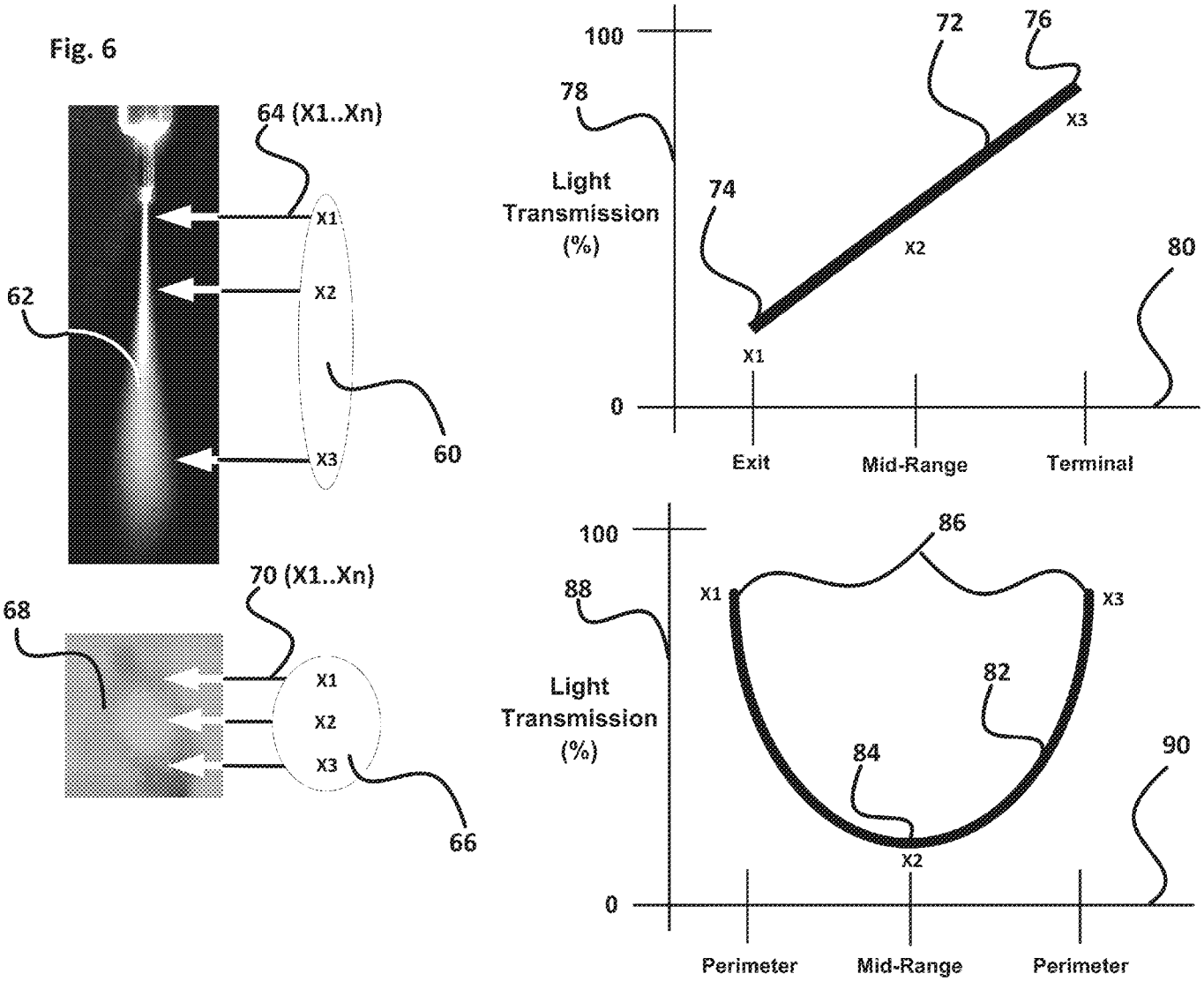
FIG. 6 schematically illustrates the measurement of a $CO_2$ Composite Spray plume in both longitudinal and perpendicular directions.

The present invention is used to characterize the composition and structure of a $CO_2$ Composite spray using both perpendicular and longitudinal spray plume analysis. As shown in FIG. 6, longitudinal measurements (60) comprise analyzing the reflective, absorption, or fluorescence properties of light as viewed into the spray plume (62) moving past the detector, or transmitted light gathering device (64). Perpendicular measurements (66) comprise analyzing the reflective, absorption, or fluorescence properties of light as viewed into the spray plume (68) moving toward the detector, or transmitted light gathering device (70).

Longitudinal spray plume measurements generally produce radiance or photometric profiles (72) characterized by a maximum absorption level (74) near the nozzle exit to a minimum absorption level (76) downrange of the nozzle exit for normalized radiance or photometric values (78) plotted against various longitudinal measurement locations (80). Longitudinal spray plume analysis is used for determining the length of the spray plume as well as its diameter at various points along the traverse. In addition, longitudinal spray plume analysis is used for correlating various longitudinal spray profiles with particle density, particle size distribution, particle velocity, pressure, and temperature.

Perpendicular spray plume measurements generally produce radiance or photometric profiles (82) characterized by a maximum absorption level (84) near the center of the spray plume and minimum absorption levels (86) at the perimeters of the spray plume for normalized radiance or photometric values (88) plotted against various perpendicular measurement locations (90). Perpendicular spray plume analysis is used for determining the diameter of the spray plume at various distances from the nozzle exit, including determining the alignment or positioning of the $CO_2$ particle injection capillary within the coaxial spray nozzle. In addition, perpendicular spray plume analysis is used for correlating various perpendicular spray profiles with particle density, particle size distribution, particle velocity, pressure, and temperature.

As discussed herein, the prior art does not teach a capability to dynamically monitor, control, and change a $CO_2$ Composite Spray in true real-time during the application of same to treat a substrate, for example during the application of a $CO_2$ Composite Spray to provide precision cooling during a machining process or a precision spray cleaning process.

In a first example, a substrate being machined can be monitored during the application of a $CO_2$ Composite Spray plume using an infrared (IR) sensor to monitor substrate heating during the machining process and then making adjustments to the spray plume to change cooling capacity and cleaning effects (i.e., spray force). However this is a reactive approach—the machined substrate is already either too hot or too cold—and the spray plume is being adjusted after-the-fact. Such reactive control schemes do not characterize the treatment spray plume characteristics in real-time as a means for dynamically controlling or changing conditions, for example treatment plume heat capacity, in relation to a particular set of key process variables such as machining path, machining speed, machining feed rate, depth of cut, type of cutting tool or coating, or composition for substrate being machined. An improved approach, and an aspect of the present invention, is to examine, correlate, and control the treatment spray plume composition in relation to the key process variables of the machining process—thus changes are being made in real-time in anticipation of changes in machining process—based on pre-determined machining command outputs (i.e., M-Codes) to the $CO_2$ Composite Spray generator. For example, during a machining process pre-determined spray plume profiles can be developed possessing the proper force, chemistry, and heat capacity dynamically during the machining process—with the present invention monitoring and controlling those profiles in real-time. As such, an IR sensor may be used as a quality control (i.e., heat management) measurement tool to correlate spray composition profiles developed using the present invention to machining processes and/or machining heat.

As another example, during a precision spray cleaning process it is critical to maintain precise spray plume composition to provide spray cleaning consistency during a given spray treatment time. Any change in treatment spray composition during the application of the treatment spray introduces variability in surface cleaning quality on the substrates being treated. This has been a challenge up to this point. A current method is to over-process the substrate due to known spray control variances and then analyze the treated (cleaned in this case) substrate surface afterward using, for example, a photoemission analyzer (i.e., OSEE monitor), impact shear stress films, or surface particle analyzer (i.e., SurfScan device). Another method is to analyze the treatment spray off-line using thermometry to make gross adjustments to the spray composition, for example $CO_2$ particle injection rate, and return the treatment spray back on-line to the cleaning process. This is disruptive to the precision cleaning processes, introducing unnecessary Takt time, and introduces unnecessary variance in surface cleaning quality level. As such, it is a key aspect of the present invention to monitor the spray plume in real time and maintain a constant composition to insure consistent cleaning process. Moreover, the present invention can make dynamic changes to same as needed to accommodate the precision cleaning process using the novel light-based monitoring, analysis, and control scheme described herein. Exemplary analytical techniques as described above may be correlated with spray plume index values or profiles to optimize precision cleaning processes for a particular type of substrate, surface contaminant (i.e., particles, residues, and heat), and processing time—providing real-time statistical process control (SPC).

Figure 7:
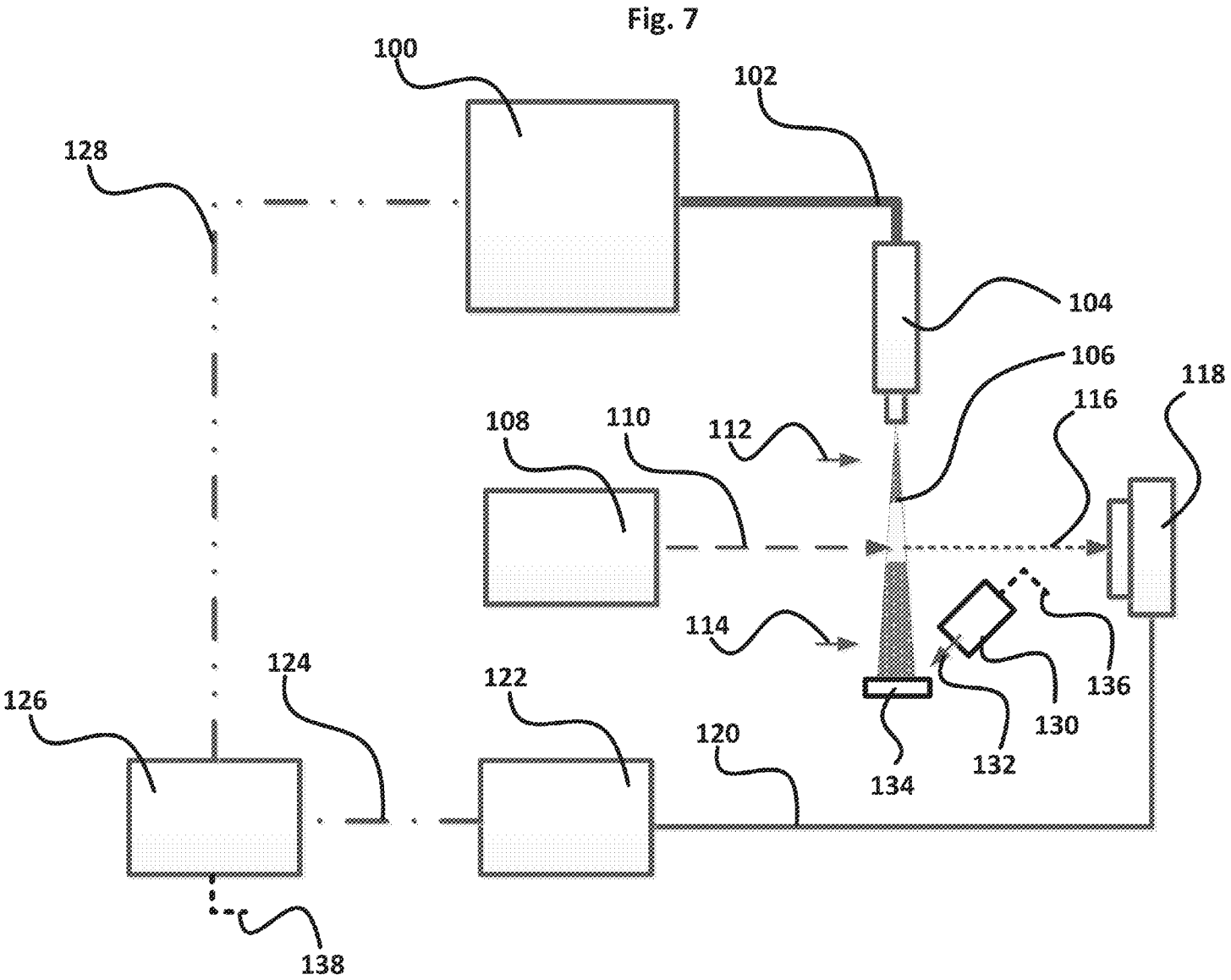
FIG. 7 schematically illustrates the exemplary system for measurement of a $CO_2$ Composite Spray plume in a perpendicular direction.

An exemplary system for analyzing and controlling the characteristics of a $CO_2$ Composite Spray is given in FIG. 7. The exemplary system shown is used to dynamically characterize a $CO_2$ Composite Spray plume and make adjustments to same as needed to maintain a pre-determined composition or to dynamically change in real-time spray plume characteristics including pressure, temperature, $CO_2$ particle density, or additive chemistry in response to (or based upon), for example, an input outside the system which is examining the substrate surface being treated with the spray plume, before, during or after substrate treatment using same. Outside analytical inputs, for example, a surface analyzer such as OSEE (Optically Stimulated Electron Emission) surface analyzer, particle measurement system, acoustic vibration measurement device, or IR thermometer may be used in the present invention to correlate treatment spray plume profiles to the precision cleaning or machining processes for which they are being applied to optimize removal or control of process contaminations—residues, particles or heat.

Now referring to FIG. 7, a spray system for use with the present invention comprises a $CO_2$ Composite Spray generator system (100), $CO_2$ spray delivery line (102), and $CO_2$ spray applicator nozzle assembly (104). Exemplary $CO_2$ Composite Spray generators and applicators suitable for use with the present invention are described under U.S. Pat. Nos. 5,725,154, 7,451,941, 7,901,540, and 8,021,489 by the first named inventor of the present invention. These exemplary $CO_2$ Composite Spray generation and application systems produce a $CO_2$ Composite Spray or treatment plume (106) having an adjustable composition comprising propellant gas flow rate, pressure and temperature, $CO_2$ particle density and particle size distribution, and optional chemical and physical additives. Common to all $CO_2$ Composite Sprays is the relationship between the characteristics and consistency of the treatment spray plume and its performance within a particular precision cleaning, machining or cooling application. Thus monitoring, maintaining, adjusting same during said application processes is very critical.

As such and again referring to FIG. 7, the present invention provides a light source (108) to produce a beam of light (110) which is passed into a portion of the spray plume along its traverse from a first position (112) to a second position (114) to create an attenuated light profile, similar to a fingerprint, of said plume, described under FIG. 6. The light source (108) may be of any variety including laser, LED, or halogen. The light source (108) may be fixed, moved, or several light sources may be used in an array along the traverse of the treatment spray plume (106). Alternatively, the spray plume (106) may be moved backwardly or forwardly from said first position (112) to said second position (114) to create a profile. One or more absorbed, reflected or otherwise attenuated light beam(s) (116) which have been passed through the treatment spray plume (106) is received by one or more light collector (s) or reflector(s) (118) connected vis-à-vis one or more sensor cable(s) (120) to one or more amplifier(s) (122), which convert the attenuated light beam(s) into a current or voltage signal(s) which are distributed using one or more cable(s) (124) into a computer processor (126). The computer processor may be any variety including industrial computer with analog input card and software or a process logic controller (PLC) and software to perform the plume profile analysis and computation as described under FIG. 6.

Alternatively, said sensor cable(s) (120) and amplifier(s) (122) may be substituted with a fiber optic sensor, fiber optic cable, and spectrophotometer (all not shown) to provide a chemical analysis of the treatment plume using wavelength-specific absorbance, fluorescence, or Raman spectroscopic analysis. The computer processor and software (126) analyzes the spray plume, performing for example analysis as described under FIG. 6, and making adjustments as required to the $CO_2$ Composite Spray generator (100) to maintain (or change) a particular treatment plume characteristic. Such adjustments can be performed using an suitable digital output device with the computer processer (126) which is connected vis-à-vis a control cable (128) to the $CO_2$ Composite Spray generator (100) to make such adjustments—for example changing propellant pressure and temperature, $CO_2$ particle injection rate, and additives as necessary to maintain or change treatment plume characteristics for a particular cleaning or machining application.

Such adjustments are necessary to either maintain a certain treatment plume characteristic or adjust same to accommodate necessary changes in the application. For example, a change in propellant pressure from a higher spray pressure level to a lower spray pressure level and maintained for a more sensitive portion of a substrate surface being cleaned, or an increase in $CO_2$ particle injection rate may be required to increase the heat capacity of the treatment spray to better manage higher machining heat at a certain stage of a machining operation. As such external analytical measurement techniques may be used in conjunction with the present invention to correlate the spray plume profile to a particular performance characteristic. Again referring to FIG. 7, for example an infrared (IR) sensor (130) and IR beam (132) can be used to create a computer look-up table correlating a range of substrate (134) surface temperatures versus spray plume (106) profiles. Substrate (134) surface temperatures can be fed (136) from the IR sensor (130) and fed (138) into a thermocouple input card (not shown) within the computer processor (126). Other types of external analytical measurement techniques such as OSEE may be used to correlate quantitative cleaning process performance (i.e., apparent cleaning rates) to treatment plume profiles.

Having thus described the preferred embodiments of the present invention, the following illustrates various uses of the present invention.

Examples of Use

As described under FIG. 1, each compound has a unique absorption fingerprint or profile—carbon dioxide absorbs in the infrared region (2), oxygen and ozone absorb in the ultraviolet region (4), and water vapor absorbs in the visible to infrared region (6). An overlay of carbon dioxide, oxygen/ozone and water demonstrates a significant amount of absorption from the ultraviolet to infrared region (8). The light-based analytical apparatus and methods described herein under FIGS. 2, 3, 4 and 5 are used for differentiating the components of a $CO_2$ Composite Spray.

Determining Ozone Concentration in a $CO_2$ Composite Spray

Ozone is used within a $CO_2$ Composite Spray to enhance cleaning and machining performance through both oxidation and oxygenation mechanisms, and is the subject of several co-pending provisional patent applications by the first named inventor of the present invention. Knowledge and control of ozone and oxygen levels within a $CO_2$ Composite Spray is important for both process optimization and quality assurance. Referring to FIG. 1, ozone absorbs (FIG. 1, (4)) strongly in the UV region between 200 nm and 300 nm and between 500 nm and 650 nm. Analyzing UV absorption characteristics within or near these regions using the apparatus described under FIG. 2 produces an absorption profile which can be correlated using the SPI calculation technique described under FIG. 5 to various ozone concentrations within a $CO_2$ Composite Spray.

Determining $CO_2$Particle Density in a $CO_2$ Composite Spray $CO_2$ Composite Spray particle size and density is a critical factor in the performance of the spray functions within a cleaning or machining operation. For example, a very lean (low $CO_2$ particle density) and a very high temperature (high propellant gas temperature and/or mass flow rate) spray composition is desirable for precision cleaning operations. A very coarse (large size) and rich (high density) particle stream entrained in a cooler propellant gas flow is more desirable for heat extraction, cooling or machining applications. As such it is important to understand and control the physical composition—particle size and density—of a $CO_2$ Composite Spray. Carbon dioxide solids entrained in a $CO_2$ Composite Spray absorb both visible and infrared radiation. As such, two light-based analytical methods are available to determine particle concentration—1) Visible light absorbance and 2) near-infrared radiation absorption. Referring to FIG. 1, carbon dioxide absorbs (FIG. 1, (2)) strongly in the near-infrared region at approximately 2000 nm. Analyzing NIR absorption characteristics at this wavelength employing the apparatus described under FIG. 2 and using a spectrophotometer produces an absorption profile which can be correlated using the SPI calculation technique described under FIG. 5 to various carbon dioxide concentrations within a $CO_2$ Composite Spray. The SPI value will account for both $CO_2$ solid and vapor concentrations combined. Alternatively, a photodiode detector allows for the selective measurement of light attenuation or obscuration. Light radiance SPI values selectively describe $CO_2$ particle concentrations as well as changes in particle size.

Determining Dryness of a $CO_2$ Composite Spray $CO_2$ Composite Spray dryness (i.e., presence of condensed water droplets) is a critical factor in the performance of the spray function within a cleaning or machining operation. For example, an ultra-dry $CO_2$ Composite Spray is representative of a very lean (low $CO_2$ particle density) and high temperature (high propellant gas temperature and/or mass flow rate) spray profile. An ultra-dry $CO_2$ Composite Spray is desirable in precision cleaning applications to prevent the condensation of atmospheric water vapor (and entrained organic and inorganic particles and residues) into the $CO_2$ Composite Spray.

Referring to FIG. 1, water vapor absorbs (FIG. 1, (6)) strongly in the visible to near-infrared region between 800 nm and 2000 nm. Analyzing the visible to NIR absorption characteristics at this range employing the apparatus described under FIG. 2 and using a spectrophotometer produces an absorption profile which can be correlated using the SPI calculation technique described under FIG. 5 to various water vapor concentrations within a $CO_2$ Composite Spray, related to $CO_2$ particle density and particle size, propellant temperature and mass flow, and atmospheric humidity. The SPI value thus calculated accounts for condensable water vapor concentrations within various $CO_2$ Composite Spray compositions.

An apparatus for maintaining a specific characteristic of a $CO_2$ treatment spray in real-time comprising: a $CO_2$ composite spray generator and a $CO_2$ composite spray applicator; said $CO_2$ Composite Spray generator and said $CO_2$ composite spray applicator create a $CO_2$ composite spray plume; said $CO_2$ composite spray plume has a geometry, which comprises a width, a height, a length, a composition or a $CO_2$ particle density; adjusting propellant gas pressure, propellant gas temperature, additive concentration, or $CO_2$ particle concentration changes said geometry of the $CO_2$ composite spray plume; a light source transmits a light beam perpendicular to said $CO_2$ composite plume from a first position to a second position; the first position to the second position defines the length of the $CO_2$ composite spray plume; a light receptor is mounted perpendicularly to the $CO_2$ composite spray plume and captures the attenuated light beam passing through or being reflected from the $CO_2$ composite spray plume; a computing device; whereby the computing device analyzes a change in the attenuated light beam passing through or being reflected from the $CO_2$ composite spray plume and adjusts the propellant gas pressure, the propellant gas temperature, the additive concentration, or the $CO_2$ particle concentration of said $CO_2$ composite spray generator to adjust said geometry to maintain the specific characteristic or a spray profile index of the $CO_2$ composite spray plume.

The light source can include halogen light, deuterium light, Laser light or LED light; the light source can operate in ultraviolet, visible or infrared regions; the light source can also include a photodiode detector, a radiance detector or a UV-VIS-IR spectrophotometer; the light receptor can measure light absorption, light reflection or light florescence.

The computing device can calculate a light attenuation profile index value for the geometry of $CO_2$ composite spray plume; said light attenuation profile index value changes with $CO_2$ particle density and particle size, the propellant gas temperature and the propellant gas pressure, organic and inorganic additives, or water vapor content within the $CO_2$ composite spray plume; the $CO_2$ composite spray plume geometry is controlled in real-time; at least one light source or at least one light receptor can be used; the $CO_2$ composite spray plume is moved from a first position to a second position; the light source and the light receptor are moved from a first position to a second position perpendicular to said $CO_2$ composite spray plume.

A metrological instrument can be used to correlate the spray plume geometry to a spray plume performance metric; said metrological instrument comprises a temperature measurement system, a OSEE measurement system, a FTIR analysis system, an impact shear stress measurement system or a surface particle counting system; the spray plume performance metric comprises cooling capacity, impact particle shear stress, contamination removal rate, surface finish, or surface cleanliness level.

A method for monitoring and maintaining a specific characteristic of a $CO_2$ treatment spray in real-time comprising:

a. Passing at least one light beam through a $CO_2$ composite spray plume;

b. Measuring at least one attenuated light beam passing through said spray plume for at least one position along a traverse of said spray plume;

c. Calculating a spray profile index value using a computing device;

d. Adjusting propellant gas pressure, propellant gas temperature, additive concentration, or $CO_2$ particle concentration of the spray plume based upon said spray profile index value;

Whereby the spray profile index is unique for the particular spray composition, the propellant gas pressure, the propellant gas temperature, the additive concentration and the $CO_2$ particle concentration; said at least one light beam comprises halogen light, deuterium light, Laser light or LED light; said at least one light beam operates in ultraviolet, visible or infrared regions; said at least one attenuated light is measured by radiance, fluorescence, absorbance or spectrophotometry; said at least one attenuated light comprises absorbed light, reflected light, or fluorescent light; the spray profile index value is correlated to a spray plume performance metric; and said spray plume performance metric comprises cooling capacity, impact particle shear stress, contamination removal rate, surface finish, or surface cleanliness.

An apparatus for maintaining a specific characteristic of a CO2 treatment spray in real-time comprising; CO2 composite spray generator and a $CO_2$ composite spray applicator; said CO2 Composite Spray generator and spray applicator creates a $CO_2$ composite spray plume; said spray plume has geometry, which comprises a width, a height, a length, a composition, and a $CO_2$ particle density; adjusting propellant gas pressure, propellant gas temperature, additive concentration, or $CO_2$ particle concentration changes said geometry of the spray plume; a light source transmits a light beam perpendicular to said plume from a first position to a second position; the first position to the second position defines the length of the spray plume; a light receptor is mounted perpendicular to the spray plume and captures the attenuated light beam as it passes through or is reflected from the spray plume; a computing device; wherein the computing device analyzes the change in the light beam as it passes through or is reflected from the plume and adjusts said propellant gas pressure, propellant gas temperature, additive concentration, or $CO_2$ particle concentration of said $CO_2$ composite spray generator to adjust said geometry to maintain the specific spray profile index or characteristic of the plume.

The light source includes halogen light, deuterium light, Laser light, and LED light; the light source operates in the ultraviolet, visible or infrared region; the light receptor includes photodiode detector, radiance detector, or UV-VIS-IR spectrophotometer; the light receptor measures light absorption, light reflection, or light florescence; the computing device calculates a light attenuation profile index value for a spray plume geometry; the light attenuation profile index value changes with CO2 particle density and particle size, propellant temperature and pressure, organic and inorganic additives, or water vapor content within the spray plume; the spray plume geometry is controlled in real-time; one or more light sources are used; one or more light receptors are used; the spray plume is moved from a first position to a second position perpendicular to said spray plume; the light source and light receptor are moved from a first position to a second position perpendicular to said spray plume; a metrological instrument is used to correlate spray plume geometry to a spray plume performance metric.

The embodiments of the invention may be implemented by a processor-based computer system. The system includes a database for receiving and storing information from users and application software for users, among other things, determining or updating usage, lifestyle characteristics, values and a user's profile, and displaying feedback information. In accordance with the present invention, computer device or computing system operates to execute the functionality for server component. Computing device or computer system includes a processor, a memory and disk storage. Memory stores computer program instructions and data. Processor executes the program instructions or software, and processes the data stored in memory. Disk storage stores data to be transferred to and from memory. Note that disk storage can be used to store data that is typically stored in the database.

All these elements are interconnected by one or more buses, which allow data to be intercommunicated between the elements. Memory is accessible by processor over a bus and includes an operating system, a program partition and a data partition. The program partition stores and allows execution by processor of program instructions that implement the functions of each respective system described herein. The data partition is accessible by processor and stores data used during the execution of program instructions.

For purposes of this application, memory and disk are machine readable mediums and could include any medium capable of storing instructions adapted to be executed by a processor. Some examples of such media include, but are not limited to, read-only memory (ROM), random-access memory (RAM), programmable ROM, erasable programmable ROM, electronically erasable programmable ROM, dynamic RAM, magnetic disk (e.g., floppy disk and hard drive), optical disk (e.g., CD-ROM), optical fiber, electrical signals, light wave signals, radio-frequency (RF) signals and any other device or signal that can store digital information. In one embodiment, the instructions are stored on the medium in a compressed and/or encrypted format. As used herein, the phrase "adapted to be executed by a processor" is meant to encompass instructions stored in a compressed and/or encrypted format, as well as instructions that have to be compiled or installed by an installer before being executed by the processor. Further, a system may contain various combinations of machine readable storage devices, which are accessible by processor and which are capable of storing a combination of computer program instructions and data. A typical computer system includes a processor, a memory, disk storage, a network interface, and a protocol stack having a CBE-communication layer and a TCP/IP layer. These elements operate in a manner similar to the corresponding elements for computer system.

A computer system also includes a network interface. Network interface may be any suitable means for controlling communication signals between network devices using a desired set of communications protocols, services and operating procedures. Communication protocols are layered, which is also referred to as a protocol stack, as represented by operating system, a CBE-communication layer, and a Transport Control Protocol/Internet Protocol (TCP/IP) layer.

Network interface may also include connectors for connecting interface with a suitable communications medium. Those skilled in the art will understand that network interface may receive communication signals over any suitable medium such as twisted-pair wire, co-axial cable, fiber optics, radio-frequencies, and so forth.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6. All cited and referenced patents, patent applications and literature are all incorporated by reference in entirety.

What is claimed:

1. An apparatus for maintaining a specific characteristic of a $CO_2$ treatment spray in real-time comprising:

a $CO_2$ composite spray generator and a $CO_2$ composite spray applicator;

said $CO_2$ Composite Spray generator and said $CO_2$ composite spray applicator create a $CO_2$ composite spray plume;

said $CO_2$ composite spray plume has a geometry, which comprises a width, a height, a length, a composition or a $CO_2$ particle density;

adjusting propellant gas pressure, propellant gas temperature, additive concentration, or $CO_2$ particle concentration changes said geometry of the $CO_2$ composite spray plume; a light source transmits a light beam perpendicular to said $CO_2$ composite plume from a first position to a second position;

the first position to the second position defines the length of the $CO_2$ composite spray plume;

a light receptor is mounted perpendicularly to the $CO_2$ composite spray plume and captures the attenuated light beam passing through or being reflected from the $CO_2$ composite spray plume;

a computing device;

whereby the computing device analyzes a change in the attenuated light beam passing through or being reflected from the $CO_2$ composite spray plume and adjusts the propellant gas pressure, the propellant gas temperature, the additive concentration, or the $CO_2$ particle concentration of said $CO_2$ composite spray generator to adjust said geometry to maintain the specific characteristic or a spray profile index of the $CO_2$ composite spray plume.

2. The apparatus of claim 1 wherein the light source includes halogen light, deuterium light, Laser light or LED light.

3. The apparatus of claim 2 wherein the light source operates in ultraviolet, visible or infrared regions.

4. The apparatus of claim 1 wherein the light receptor includes a photodiode detector, a radiance detector or a UV-VIS-IR spectrophotometer.

5. The apparatus of claim 4 wherein the light receptor measures light absorption, light reflection or light florescence.

6. The apparatus of claim 1 wherein said computing device calculates a light attenuation profile index value for the geometry of $CO_2$ composite spray plume.

7. The apparatus of claim 6 wherein said light attenuation profile index value changes with $CO_2$ particle density and particle size, the propellant gas temperature and the propellant gas pressure, organic and inorganic additives, or water vapor content within the $CO_2$ composite spray plume.

8. The apparatus of claim 1 wherein the $CO_2$ composite spray plume geometry is controlled in real-time.

9. The apparatus of claim 2 wherein at least one light source is used.

10. The apparatus of claim 4 wherein at least one light receptor is used.

11. The apparatus of claim 1 wherein the $CO_2$ composite spray plume is moved from a first position to a second position.

12. The apparatus of claim 1 wherein the light source and the light receptor are moved from a first position to a second position perpendicular to said $CO_2$ composite spray plume.

13. The apparatus of claim 1 wherein a metrological instrument is used to correlate the spray plume geometry to a spray plume performance metric.

14. The apparatus of claim 13 wherein said metrological instrument comprises a temperature measurement system, a OSEE measurement system, a FTIR analysis system, an impact shear stress measurement system or a surface particle counting system.

15. The apparatus of claim 13 wherein the spray plume performance metric comprises cooling capacity, impact particle shear stress, contamination removal rate, surface finish, or surface cleanliness level.

16. A method for monitoring and maintaining a specific characteristic of a $CO_2$ treatment spray in real-time comprising:

a. Passing at least one light beam through a $CO_2$ composite spray plume;

b. Measuring at least one attenuated light beam passing through said spray plume for at least one position along a traverse of said spray plume;

c. Calculating a spray profile index value using a computing device;

d. Adjusting propellant gas pressure, propellant gas temperature, additive concentration, or $CO_2$ particle concentration of the spray plume based upon said spray profile index value;

Whereby the spray profile index is unique for the particular spray composition, the propellant gas pressure, the propellant gas temperature, the additive concentration and the CO2 particle concentration.

17. The method of claim 16 wherein said at least one light beam comprises halogen light, deuterium light, Laser light or LED light.

18. The method of claim 17 wherein said at least one light beam operates in ultraviolet, visible or infrared regions.

19. The method of claim 16 wherein said at least one attenuated light is measured by radiance, fluorescence, absorbance or spectrophotometry.

20. The method of claim 19 wherein said at least one attenuated light comprises absorbed light, reflected light, or fluorescent light.

21. The method of claim 16 wherein the spray profile index value is correlated to a spray plume performance metric.

22. The method of claim 21 wherein said spray plume performance metric comprises cooling capacity, impact particle shear stress, contamination removal rate, surface finish, or surface cleanliness.

* * * * *